US005479093A

United States Patent [19]

Jeon

[11] Patent Number: 5,479,093

[45] Date of Patent: Dec. 26, 1995

[54] INTERNAL VOLTAGE GENERATING CIRCUIT OF A SEMICONDUCTOR DEVICE

[75] Inventor: Jun-Young Jeon, Seoul, Rep. of Korea

[73] Assignee: Samsung Electronics Co., Ltd., Suwon, Rep. of Korea

[21] Appl. No.: 46,857

[22] Filed: Apr. 15, 1993

[30] Foreign Application Priority Data

May 21, 1992 [KR] Rep. of Korea ..... 92-8655

[51] Int. Cl.[6] ..... G05F 3/16

[52] U.S. Cl. ..... 323/313; 323/273

[58] Field of Search ..... 323/313, 314, 323/303, 273, 274, 270, 269; 363/101

[56] References Cited

U.S. PATENT DOCUMENTS 3,806,742 4/1974 Powell ..... 307/304

4,916,389 4/1990 Hori et al. ..... 324/158 T

*Primary Examiner*—Peter S. Wong
*Assistant Examiner*—Adolf Berhane
*Attorney, Agent, or Firm*—Cushman Darby & Cushman

[57] ABSTRACT

An internal voltage generating circuit of a semiconductor device for receiving an external voltage and generating an internal voltage. In a first voltage interval of the external voltage the internal voltage increases linearly according to the external voltage until a reference voltage is reached. In a second voltage range of the external voltage the internal voltage remains at the reference voltage. After the second voltage range, the internal voltage sharply increases and increases linearly thereafter. Accordingly, the circuit can improve the reliability of the tested semiconductor device.

8 Claims, 2 Drawing Sheets

INTERNAL VOLTAGE GENERATING CIRCUIT OF A SEMICONDUCTOR DEVICE

BACKGROUND OF THE INVENTION

1. Field of the Invention

The present invention relates to a semiconductor device and, more particularly to an internal voltage generating circuit within a semiconductor device.

2. Description of the Related Art

An internal voltage generating circuit regulates internal voltage at a constant predetermined value within a highly integrated semiconductor device. Generally, the internal voltage is obtained by reducing an external voltage down to the predetermined voltage level. The internal voltage generating circuit operates in either a standard mode for normal operation or a test mode for chip reliability testing depending on the externally supplied voltage. Ordinarily, a normal mode test and a stress mode test are available in the test mode.

The normal mode test uses an internal voltage regulator that lowers the external voltage to an internal reference voltage. The voltage regulator typically supplies an internal reference voltage of about +5V.

In the stress test mode, the internal voltage must be higher than the reference voltage. However, raising the internal voltage cannot be accomplished since the voltage regulator generates the predetermined reference voltage. Therefore, an output terminal of the voltage regulator circuitry has a voltage boosting circuit to execute the test. In this mode, the boosting circuit generates a boosted voltage of about 6–7 volts.

FIG. 1 is a circuit diagram illustrating a conventional internal voltage generating circuit of a semiconductor device. A voltage regulator 10 is connected between voltage supply terminals $V_{ext}$ and $V_{ss}$ and supplies a reference voltage $V_{ref}$ on internal voltage terminal $V_{int}$. A boosting circuit 11 is connected between the voltage supply terminal $V_{ext}$ and the internal voltage terminal $V_{int}$. Boosting circuit 11 has a plurality of serially connected PMOS transistors $M_1$–$M_n$. In each of the PMOS transistors, their source electrode is connected with their substrate and their gate electrode is commonly connected with their drain electrode. The reference voltage $V_{ref}$ is used to perform the normal mode test. The boosting circuit 11 boosts the voltage supplied on the internal voltage terminal $V_{int}$ above the reference voltage $V_{ref}$.

FIG. 2 is a graph showing the relationship between the internal supply voltage $V_{int}$ and an external supply voltage $V_{ext}$ of the circuit shown in FIG. 1. A low range of the external supply voltage is the range below $V_3$. In the low range, the internal supply voltage $V_{int}$ generated by the voltage regulator 10 increases linearly to the value $V_{ref}$. A middle range of the external supply voltage is the range between $V_3$ and $V_4$. In the middle range, the internal supply voltage $V_{int}$ remains at the reference voltage $V_{ref}$. A high range of the external supply voltage is the range above $V_4$. In the high range, the internal supply voltage $V_{int}$ increases linearly again. That is, the internal supply voltage $V_{int}$ increases proportionally to the external supply voltage $V_{ext}$ (after being held constant at the reference voltage $V_{ref}$), when the voltage difference between the external supply voltage $V_{ext}$ and the reference voltage $V_{ref}$ exceeds a threshold voltage $n \cdot V_{th}$ (the sum of the transistor thresholds) of the n PMOS transistors in the boosting circuit 11.

In other words, when the conventional internal voltage generating circuit uses the boosting circuit 11, the internal supply voltage $V_{int}$ is $Vext-(n \cdot V_{th})$ obtained by subtracting the summed threshold voltages across boosting circuit 11 from the external supply voltage $V_{ext}$. If a plurality of PMOS transistors constituting boosting circuit 11 are used, so that the threshold voltage $(n \cdot V_{th})$ circuit 11 across boosting is large, external supply voltage $V_{ext}$ applied during the reliability test should be very high. In this case, the reliability of the transistors to which external supply voltage $V_{ext}$ is directly applied can be greatly eroded. Conversely, if the number of the PMOS transistors in the boosting circuit 11 is reduced to the minimum, the threshold voltage, $(n \cdot V_{th})$ is reduced. Therefore, the internal supply voltage $V_{int}$ increases at low external supply voltage $V_{ext}$. Accordingly, the reliability test is not as effective.

SUMMARY OF THE INVENTION

It is an object of the present invention to provide an internal voltage generating circuit which can generate a stable internal supply voltage irrespective of external supply voltage fluctuations and capable of boosting the internal supply voltage even if low external supply voltage is applied during reliability testing.

The internal voltage generating circuit has a voltage regulator, a first boosting circuit and a second boosting circuit connected in parallel between an external supply terminal and an internal supply terminal. The voltage regulator generates a comparison voltage and an internal voltage. The internal voltage is regulated at a predetermined reference voltage when the voltage regulator is operating in the normal mode. A comparator receives the internal supply voltage, the comparison voltage and the external supply voltage and generates a trigger signal. A driver buffers the trigger signal before supplying it to the second boosting circuit. When the difference between the external supply voltage and the reference voltage exceeds the threshold voltage of the first boosting circuit, the first boosting circuit boost the internal supply voltage above the internal voltage to increase linearly as the external supply voltage increases. The comparator compares the internal supply voltage to the comparison voltage and generates the trigger signal when the difference between the two voltages exceeds a predetermined value. The trigger signal enables the second boosting circuit to boost the internal supply voltage to a predetermined value below the external supply voltage.

BRIEF DESCRIPTION OF THE DRAWINGS

Further features and advantages will become more apparent from the following description of the preferred embodiment of the invention as illustrated in the accompanying drawings in which the same reference characters generally refer to like parts throughout the views, and in which.

DETAILED DESCRIPTION OF THE INVENTION

Figure 1:
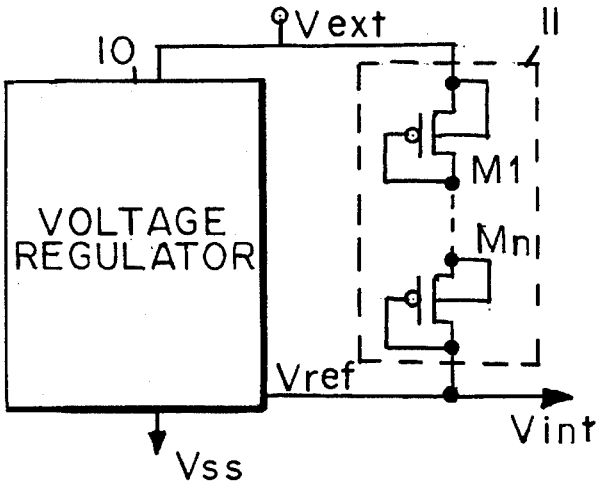
Fig. 1. (PRIOR ART)
FIG. 1 is a circuit diagram illustrating a conventional internal voltage generating circuit in a semiconductor device.
Figure 2:
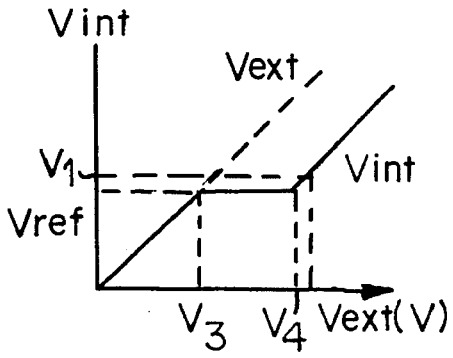
Fig. 2. (PRIOR ART)
FIG. 2 is a graph showing the relationship of the internal supply voltage with respect to the external supply voltage of the circuit shown in FIG. 1.
Figure 3:
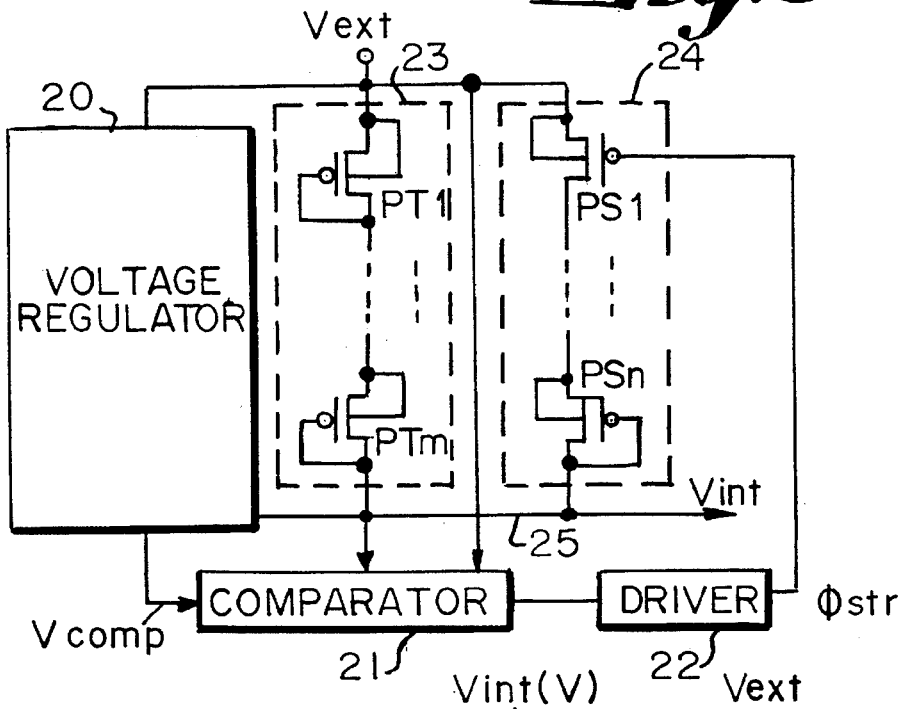
FIG. 3 is a circuit diagram illustrating an internal voltage generating circuit according to the present invention.

An internal voltage generating circuit of a semiconductor device according to the present invention is generally shown in the circuit diagram illustrated in FIG. 3. A voltage regulator 20, a first boosting circuit 23, a second boosting circuit 24 and a comparator 21 are connected in parallel between an external supply voltage terminal $V_{ext}$ and internal supply voltage terminal $V_{int}$. A comparison voltage terminal $V_{comp}$ connects the voltage regulator 20 to the comparator 21. A driver 22 receives the output of the comparator 21 and outputs a trigger signal $\Phi_{STR}$ to the second boosting circuit 24. The voltage regulator 20 generates a comparison voltage $V_{comp}$ and an internal supply voltage $V_{int}$ which is compared by comparator 21. The second boosting circuit 24 is responsive to the comparator 21 (through trigger signal $\Phi_{STR}$) and boosts the internal voltage $V_{int}$ to a predetermined voltage relative to the external supply voltage. In addition the first boosting circuit 23 boosts the internal supply voltage $V_{int}$.

The first boosting circuit 23 has a plurality of serially connected PMOS transistors $PT_1$ through $PT_m$. Each of the source electrodes of the PMOS transistors is connected to its respective substrate. Also, all the gate electrodes of the PMOS transistors $PT_1$ to $PT_m$ are connected to their respective drain electrodes.

The second boosting circuit 24 has serially connected PMOS transistors $PS_1$ through $PS_n$. The source electrode and the substrate of the PMOS transistor $PS_1$ are connected to the external supply voltage terminal $V_{ext}$. The gate electrode of the PMOS transistor $PS_1$ is connected to the trigger signal terminal $\Phi_{STR}$ (of driver circuit 22). Each of the source electrodes of the PMOS transistors $PS_2$–$PS_n$ are connected with the respective substrates. In addition, all of the gate electrodes of the PMOS transistors $PS_2$ to $PS_n$ are connected in common with their respective drain electrodes.

Figure 4:
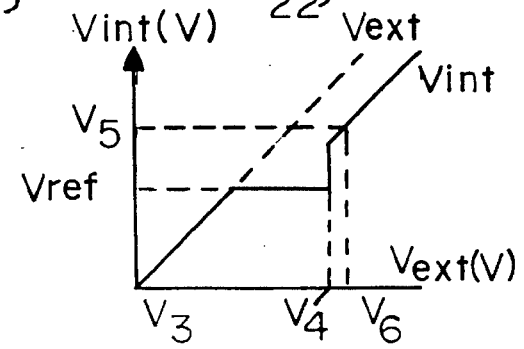
FIG. 4 is a graph showing the relationship of the internal supply voltage with respect to the external supply voltage of the circuit shown in FIG. 3.

FIG. 4 is a graph showing the relationship of the internal supply voltage $V_{int}$ with respect to the external supply voltage $V_{ext}$ of the circuit shown in FIG. 3. Within the low voltage range in which external supply voltage $V_{ext}$ is low (below $V_3$), internal supply voltage $V_{int}$ increases linearly up to the reference voltage $V_{ref}(V_3)$ . When external supply voltage $V_{ext}$ is in the middle voltage range (between $V_3$ and $V_4$), internal supply voltage $V_{int}$ maintains a level equal to the reference voltage $V_{ref}$. Within the high voltage range in which external supply voltage $V_{ext}$ is high (above $V_4$), internal supply voltage $V_{int}$ rises sharply and thereafter increases linearly again.

Figure 5:
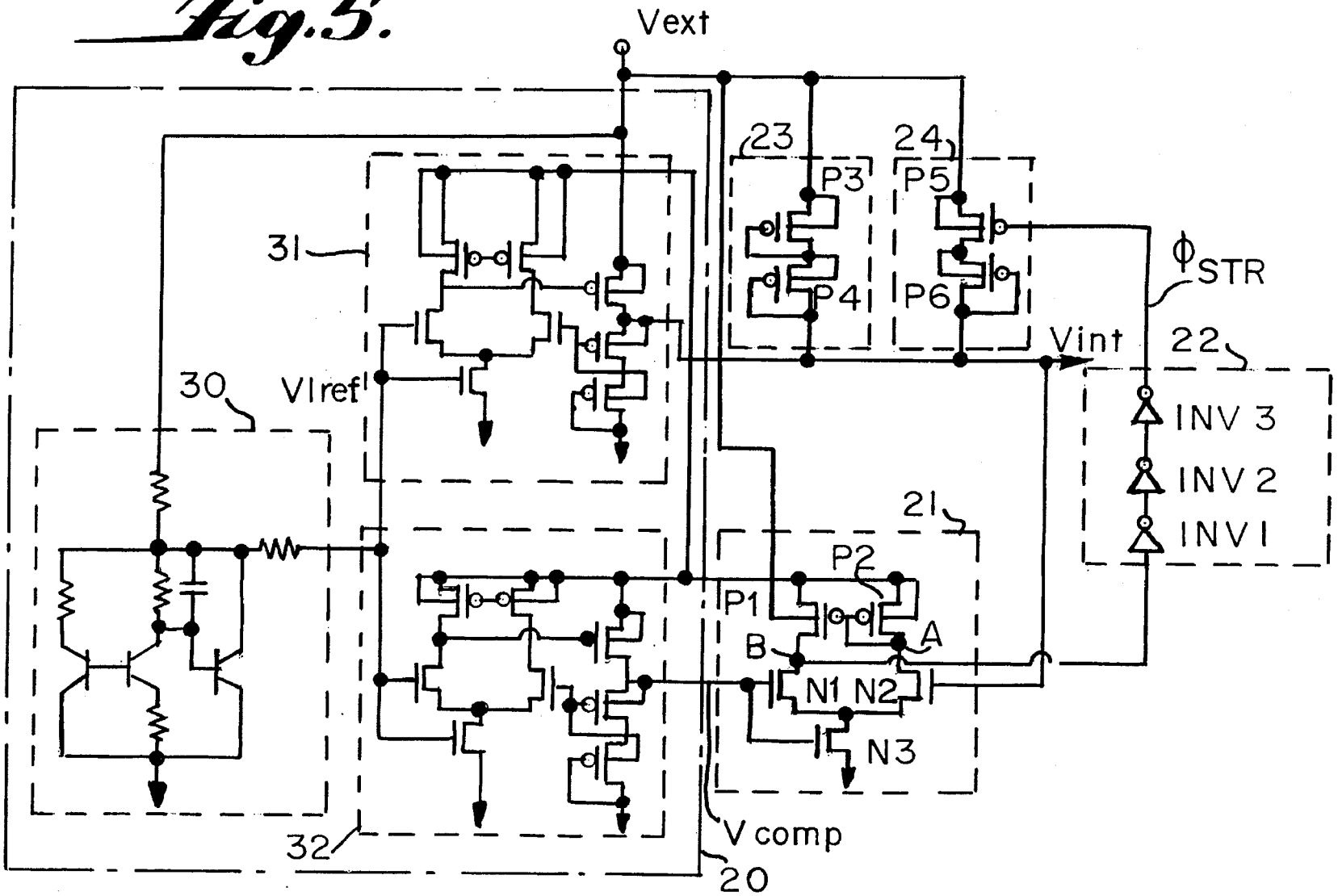
FIG. 5 is a circuit diagram illustrating an internal voltage generating circuit according to one preferred embodiment of the present invention.

FIG. 5 is a circuit diagram illustrating one embodiment of the internal power generating circuit shown in the circuit illustrated in FIG. 3. The voltage regulator 20 has a reference voltage generating circuit 30, a first amplifying circuit 31 and a second amplifying circuit 32 connected in parallel between the external supply voltage terminal $V_{ext}$ and ground. The reference voltage generating circuit 30 supplies an internal reference voltage $VI_{REF}$ to the first and second amplifying circuits 31 and 32 respectively. The first amplifying circuit 31 supplies the internal supply voltage $V_{int}$ to the first and second boosting circuits 23 and 24 and comparator circuit 21 respectively. The second amplifying circuit 32 supplies the comparison voltage $V_{comp}$ to the comparator circuit 21.

The comparator circuit 21 has a PMOS transistor P1 with its source electrode and substrate commonly connected to the external supply voltage terminal $V_{ext}$. Another PMOS transistor P2 has its source electrode and substrate commonly connected to the external supply voltage terminal $V_{ext}$, and its gate and drain electrodes commonly connected to the gate electrode of the PMOS transistor P1. An NMOS transistor N1 has its drain electrode commonly connected to the input of the driver 22 and the drain electrode of the PMOS transistor P1, and its gate electrode connected to the comparison voltage terminal $V_{comp}$. Another NMOS transistor N2 has its drain electrode commonly connected to the drain and gate electrodes of the PMOS transistor P2, and its gate electrode connected to the internal supply voltage terminal $V_{int}$. Finally, an NMOS transistor N3 has its drain electrode commonly connected to the source electrodes of the NMOS transistors N1 and N2, its gate electrode is connected to the comparison voltage terminal $V_{comp}$ and its source electrode connected to ground.

The driver circuit 22 has three serially connected inverters INV1, INV2, and INV3 receiving the output from the drain electrode of the NMOS transistor N1 (of the comparator circuit 21). Inverter INV3 generates the trigger signal $\Phi_{STR}$.

The first boosting circuit 23 has a PMOS transistor P3 with its source electrode and substrate commonly connected to the external supply voltage terminal $V_{ext}$, and its gate and drain electrodes commonly connected. A PMOS transistor P4 has its source electrode and substrate commonly connected to the drain electrode of the PMOS transistors P3, and its gate and drain electrodes commonly connected to the internal supply voltage terminal $V_{int}$.

The second boosting circuit 24 has a PMOS transistor P5 with its source electrode and substrate commonly connected to the external supply voltage terminal $V_{ext}$, and its gate electrode connected to the output of inverter INV3 (of driver 22). A PMOS transistor P6 has its source electrode and substrate commonly connected to the drain electrode of the PMOS transistor P5, and its gate and drain electrodes commonly connected to the internal supply voltage terminal $V_{int}$.

In the above embodiment, the first and second boosting circuits 23 and 24 each have only two PMOS transistors. However, more PMOS transistors can be connected thereto to change the boosting characteristics.

The operation of the apparatus having the above structure will be explained below with an assumption that the threshold voltage $V_{th}$ of each of the transistors in the first and second boosting circuit 23 and 24 is 0.8V. Initially, when a predetermined range of the external supply voltage $V_{ext}$ is applied to the voltage regulator 20, the internal supply voltage $V_{int}$ (from first amplifying circuit 31) and the comparison voltage $V_{comp}$ (from second amplifying circuit 32) are equal. In the comparator circuit 21, the bias current of the NMOS transistor N1 (receiving the reference voltage $V_{ref}$) is set to be larger than that of the NMOS transistor N2 (receiving internal supply voltage $V_{int}$), so the drain electrode potential of the NMOS transistor N1 is lower than the drain electrode potential of the NMOS transistor N2.

When the voltage difference between the external supply voltage $V_{ext}$ and internal supply voltage $V_{int}$ is greater than or equal to a summed threshold voltage ($2 \cdot V_{th}$), the first boosting circuit 23 is enabled. Thus, the internal supply voltage $V_{int}$ increases proportionally to the external supply voltage $V_{ext}$. The trigger signal $\Phi_{STR}$ output from driver circuit 22 changes from logic level "low" to "high" since the drain electrode potential of the NMOS transistor N1 (of the comparator circuit 21) is higher than that of the NMOS transistor N2. Subsequently, the second boosting circuit 24 (receiving the trigger signal $\Phi_{STR}$ of driver circuit 22) is enabled, so that a voltage of $V_{th}$ is maintained between the internal supply voltage $V_{int}$ and the external supply voltage $V_{ext}$. According to the above assumption, a voltage difference of about 0.8V (1 $V_{th}$) is maintained. The present invention can vary the boosting level according to the number of transistors within the boosting circuits. Here, at least one transistor should be used. Of course, the precise configurations at the 1st and 2nd boosting circuits can be adjusted to achieve desired test voltage levels.

Therefore, the internal voltage generating circuit of the semiconductor device according to the present invention outputs a predetermined voltage by the voltage regulator irrespective of variations in the external supply voltage $V_{ext}$ during the normal mode. Also, since the internal supply voltage $V_{int}$ can be increased by the boosting circuits even when low external voltages $V_{ext}$ are applied during reliability testing, the reliability of a tested semiconductor device can be improved.

What is claimed is:

1. A voltage generating circuit within a semiconductor device comprising:

regulating means receiving an external voltage for generating an internal voltage of a predetermined reference value less than the external voltage and a comparison voltage;

first boosting means for boosting the internal voltage above the predetermined reference value and lower than the external voltage to a firstly boosted voltage when the external voltage exceeds a first threshold value; and second boosting means for boosting the internal voltage above the firstly boosted voltage and lower than the external voltage when a difference between the internal voltage and the comparison voltage exceeds a second threshold value, the second boosting means including means for raising the internal voltage sharply with a positive slope toward a value of the external voltage when the difference between the internal voltage and the comparison voltage reaches the second threshold value.

2. A voltage generating circuit within a semiconductor device according to claim 1, wherein:

the regulating means includes means for increasing the internal voltage to the predetermined reference value as the external voltage increases to a first voltage, and for maintaining the internal voltage at the predetermined reference value as the external voltage increases from the first voltage toward the first threshold value.

3. A voltage generating circuit within a semiconductor device according to claim 1, further comprising:

comparator means for comparing the internal voltage and the comparison voltage and generating a trigger signal when the internal voltage exceeds the comparison voltage.

4. A voltage generating circuit for a semiconductor device comprising:

a voltage regulator connected to an external voltage terminal, the voltage regulator generating a reference voltage at an internal voltage terminal and generating a comparison voltage;

a first transistor circuit connected between the external voltage terminal and the internal voltage terminal and having a first voltage drop when active;

a second transistor circuit connected between the external voltage terminal and the internal voltage terminal and having a second voltage drop less than the first voltage drop when active, the second transistor circuit raising the reference voltage at the internal voltage terminal sharply with a positive slope toward a value of the external voltage terminal when the second transistor circuit is activated and the external voltage reaches a threshold value;

a comparator circuit receiving the comparison voltage and connected to the internal voltage terminal, the comparator circuit generating a trigger signal, the trigger signal activating the second transistor circuit.

5. A voltage generating circuit according to claim 4, wherein the second transistor circuit comprises:

a first MOS transistor having a source connected to the external voltage terminal and a gate receiving the trigger signal;

a second MOS transistor having a source connected to a drain of the first MOS transistor and a drain connected to the internal voltage terminal.

6. A voltage generating circuit according to claim 4, wherein the comparator circuit comprises:

a first PMOS transistor having a source connected to the external voltage terminal;

a second PMOS transistor having a source connected to the source of the first PMOS transistor, and the second PMOS transistor having a gate and a drain connected to a gate of the first PMOS transistor;

a first NMOS transistor having a drain connected to a drain of the first PMOS transistor and the first NMOS transistor having a gate receiving the comparison voltage;

a second NMOS transistor having a drain connected to the drain of the second PMOS transistor, the second NMOS transistor having a source connected to the source of the first NMOS transistor, and the second NMOS transistor having a gate connected to the internal voltage.

7. A voltage generating circuit according to claim 6, further comprising a third NMOS transistor having a drain connected to a source of the first NMOS transistor, the third NMOS transistor having a source connected to ground, and the third NMOS transistor having a gate receiving the comparison voltage.

8. An internal voltage generating circuit within a semiconductor device comprising:

a voltage regulator receiving an external voltage and generating an internal voltage and a comparison voltage;

a first boosting circuit boosting the internal voltage above a first reference voltage value;

a comparison circuit comparing the internal voltage and the comparison voltage and generating a trigger signal; and a second boosting circuit boosting the internal voltage above a second reference voltage value higher than the first reference voltage value in response to the trigger signal;

wherein the internal voltage increases linearly toward the first reference voltage value as the external voltage increases toward a first value, the internal voltage remains at the first reference voltage value as the external voltage increases from the first value toward a threshold value, the internal voltage increases sharply with a positive slope above the first reference voltage value as the external voltage reaches the threshold value, and the internal voltage increases further as the external voltage exceeds the threshold value.

* * * * *